United States Patent [19]

Torterotot

[11] Patent Number: 4,798,235

[45] Date of Patent: Jan. 17, 1989

[54] METERING AND DISPENSING DEVICE FOR THE PACKING OF LIQUIDS PRODUCTS

[75] Inventor: Roland Torterotot, Saint Arnoult en Yvelines, France

[73] Assignee: Societe a Responsabilite Limitee: Erca Holding, Les Ulis, France

[21] Appl. No.: 58,281

[22] Filed: Jun. 4, 1987

[30] Foreign Application Priority Data

Jun. 5, 1986 [FR] France ..... 86 08138

[51] Int. Cl.[4] ..... B67D 5/34

[52] U.S. Cl. ..... 141/258; 141/286

[58] Field of Search ..... 141/175, 137, 138, 140–147, 141/163, 178, 181, 191, 251, 255, 258, 259, 260, 261, 285, 86, 237

[56] References Cited

U.S. PATENT DOCUMENTS 3,097,672 7/1963 Minard ..... 141/147 X
3,168,225 2/1965 Miller et al. ..... 141/147 X
3,841,363 10/1974 Stigler ..... 141/142
3,850,345 11/1974 Merritt ..... 141/258

FOREIGN PATENT DOCUMENTS 2711208 9/1978 Fed. Rep. of Germany .
3024489 1/1982 Fed. Rep. of Germany .
2067983 8/1971 France .
7312344 11/1973 France .

*Primary Examiner*—Henry J. Recla
*Assistant Examiner*—Ernest G. Cusick
*Attorney, Agent, or Firm*—Dennison, Meserole, Pollack & Scheiner

[57] ABSTRACT

The invention relates to the packing of liquid products. A piston, moving inside a cylindrical metering chamber, introduces successive quantities of liquid in pots via a tubular nozzle vertically movable, which can be entirely retracted inside the dispensing chamber and which is equipped with a truncated bubble trap for eliminating the gases issued from the liquid.

16 Claims, 3 Drawing Sheets

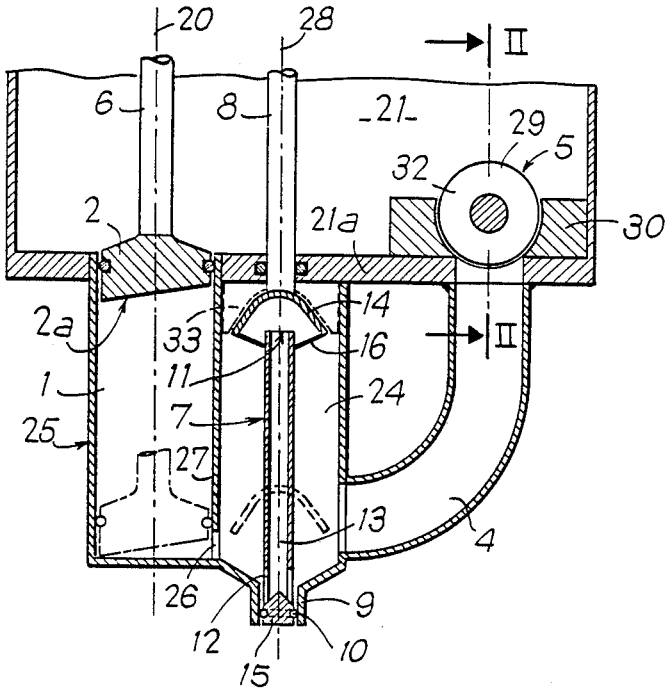
Fig. 1
Fig. 2
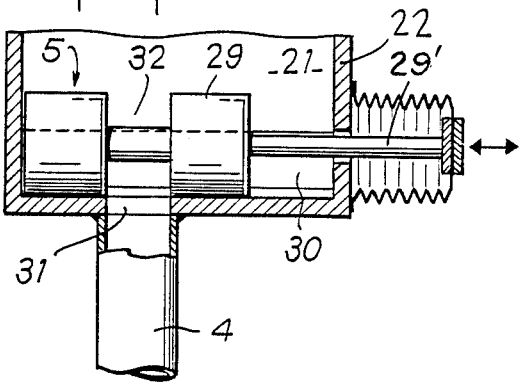
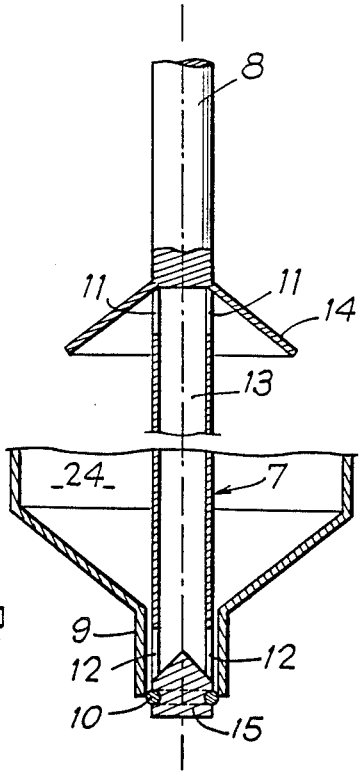
Fig. 3

METERING AND DISPENSING DEVICE FOR THE PACKING OF LIQUIDS PRODUCTS

FIELD OF THE INVENTION

The present invention relates to a metering and dispensing device for the packing of liquid products, such as for example food products, in pots or similar containers, comprising metering means equipped with a piston movable inside a cylindrical metering chamber connected, via a closing valve, to a source of product, dispensing means equipped with downwardly facing tubular nozzle, and having an inlet orifice and an ejection orifice, movable longitudinally, and comprising a dispensing chamber which communicates, on the one hand, with the metering chamber and, on the other hand, with the outside through the tubular nozzle and a closing member operationally coupled to said nozzle, and actuating means for actuating the piston and the nozzle in such a way as to lower the latter before filling each container with liquid introduced therein via said nozzle under the delivery action of the piston.

BACKGROUND OF THE INVENTION

In devices of this type, already known for example from French Pat. No. 2,067,983, the tubular nozzle forms part of a dispensing head which is vertically movable so as to introduce the nozzle into a container, as far as the bottom thereof, and to bring it out therefrom. When the containers are filled inside a sterile enclosure, such as a tunnel, through the top of which the movable dispensing head penetrates into a sort of gasproof lock chamber, sterilization of the elements of the dispensing means which are in contact with the liquid product to be paceked, is difficult, and, particularly sterilization of the container-filling nozzle which is fixed under the movable dispensing head, partly in the open and partly inside the tunnel, and which is imparted with a vertical reciprocating movement. In order to make sterilization of the elements of the dispensing means in contact with the liquid product to be packed easier, it has been proposed to immobilize the dispensing head by fixing it on the tunnel and to introduce into the sterile tunnel, nozzle end parts of very small length. However, the sterilization of such nozzle ends always raises a problem and also, this type of short nozzle does not permit the dispensing of foaming products such as milk. Moreover, the accumulation in the metering chamber of the gaseous fractions contained in any liquid product, progressively alters the metered quantity of liquid introduced each time in said chamber, so that the quantity of liquid prepared for filling the packing containers reduces progressively.

SUMMARY OF THE INVENTION

It is the object of the present invention to propose a solution to these problems with a metering device in which the metered quantities remain substantially constant and which is easily sterilizable.

The device according to the invention is characterized first of all by the fact that the metering chamber and the dispensing chamber are re-grouped inside the same enclosure, that the transit channel of the tubular nozzle is permanently closed, at least at the lower end of the nozzle by a transversal plug, that at least one lower nozzle-ejection orifice issues onto the side face of said nozzle just above said transversal plug, that the wall which surrounds, inside the same enclosure, the metering and dispensing chambers is provided at the bottom with a guiding neck adjusted to the tubular nozzle which is mounted therein in tight manner in such a way as to be slidable therein between, on the one hand, a high position in which the ejection orifice is contained inside the guiding neck and is isolated from the outside, and the inlet orifice neck and is isolated from the outside, and the inlet orifice of the nozzle is situated at the upper part of the dispensing chamber which then receives the whole of the nozzle tube with the exception of the lower end part thereof and, on the other hand, a low position in which most of the nozzle projects downwardly from the guiding neck with the exception of its upper end part, of which the inlet orifice is then situated near the bottom of the dispensing chamber, and that the inlet orifice of the tubular nozzle is topped with and surrounded by a gas bubble trap in the form of an overturned bowl which is fast with the upper end of the tubular nozzle and has a smaller contour than the dispensing chamber in order to prevent any really substantial pumping effect.

With this disposition which closely re-groups the metering and dispensing means, the structure of the device according to the invention remains simple and compact. The enclosure of the metering means can be mounted outside the tunnel so that only one endpart of the guiding neck traverses tightly the upper wall of the tunnel and penetrates therein. Thus, a perfect and thorough sterilization of the metering means and in particular of the nozzle becomes possible; to this effect, it is enough to introduce into the chamber, while the nozzle is retracted therein in high position, overheated water or steam at a suitable temperature. According to this particular design, the tubular nozzle can go down through the tunnel to the bottom of a container and fill that container in a sterile atmosphere with a foaming product.

Beneath the lower ejection orifice provided in the side wall of the nozzle at the level of the transversal plug closing off the inner transit conduit or channel thereof, said nozzle is equipped with a sealing ring which applies against the guiding neck when the nozzle reaches its high position; so that the outflow of liquid through the nozzle is then interrupted. Thus, the lower end of the nozzle acts as a valve, operationally coupled to the guiding neck, and can close off the dispensing chamber and the metering chamber during a new filling phase of the latter;

The disposition according to the invention further permits the simple and straightforward elimination of the gases contained in the liquid which, heretofore, had a tendency to accumulate in the metering chamber. The gas bubbles generally form during the rising stroke of the nozzle and piston, and rise into the dispensing chamber preferably along the tubular nozzle, and they are stopped on their rising path and regrouped under the bubble trap for subsequent removal with the liquid during the filling of the next container. As a result, all the containers are ensured to receive exactly the wanted quantity of product.

BRIEF DESCRIPTION OF THE DRAWINGS

The invention will be more readily understood on reading the following description with reference to the accompanying drawings, in which:

FIG. 1 is an elevational view of a vertical section across a first embodiment of the metering and dispensing device according to the invention;

FIG. 2 is a cross-sectional view of one detail, taken along line II—II of FIG. 1;

FIG. 3 is an elevational partly cross-sectional view of the tubular nozzle, shown on a larger scale;

DETAILED DESCRIPTION OF THE INVENTION

Figure 4:
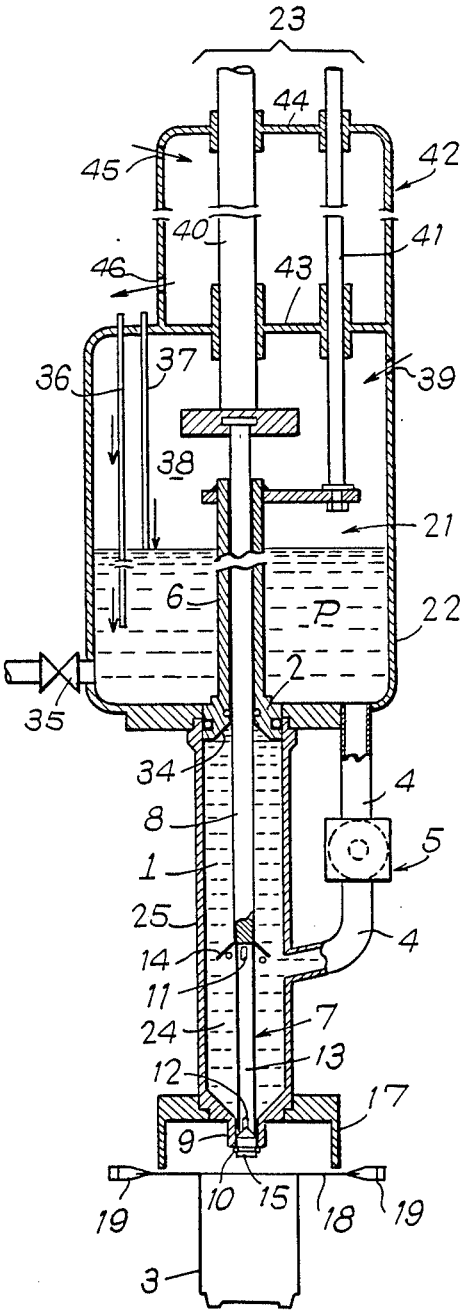
FIG. 4 diagrammatically shows an axial section of a second embodiment of the device after the filling of the metering chamber.

The metering and dispensing device illustrated in the drawings comprises a metering pump constituted by a cylindrical metering chamber 1 of circular cross-section and vertical axis 20 inside which a piston 2 moves according to a reciprocating movement, said chamber being connected to a reservoir 21 containing a liquid food product P to be packed in containers such as pot 3, through a conduit 4 via an admission valve such as a slide valve 5. At its upper part, piston 2 is connected, via a control rod 6, with actuating means 23 which causes it to move over a specific path between a high position (FIGS. 1, 4 and 5) situated at the top of the metering chamber 1, and a low position (FIGS. 1, in dotted line, 6 and 7) situated at the bottom part of the chamber 1, at the outlet part of conduit 4. The metering and dispensing device further comprises a dispensing chamber 24 which, according to a first embodiment, is situated next to metering chamber 1, inside the same enclosure 25 as said metering chamber 1, and communicates with said metering chamber 1 via an opening 26 provided in the lower part of a partition wall 27 provided between the two chambers 1 and 24. The two metering and dispensing chambers are, in this particular case, juxtaposed, and their axes 20 and 28 are parallel. The reservoir 21 containing the liquid P to be packed is placed directly above metering chamber 1 and dispensing chamber 24 so that its bottom 21*a* also constitutes the upper wall of dispensing chamber 24. The volume of reservoir 21 is in direct communication with the upper face of piston 2 and with the part of meterering chamber 1 situated above piston 2. As a result, the rod 6 of piston 2 goes through reservoir 21 and the inner face of the side wall of the metering chamber 1 is always kept very wet, i.e. very lubricated, by the liquid product P contained in reservoir 21.

Dispensing chamber 24 comprises a tubular nozzle 7 of vertical axis coinciding with the axis 28 of chamber 24. The bottom of dispensing chamber 24 is provided with a guiding neck 9 adjusted to the tubular nozzle 7 which is connected at its upper end with a coaxial massive rod 8 traversing in tight manner the bottom wall 21a of reservoir 21 which, according to FIG. 1, also constitutes the upper wall of dispensing chamber 24. Tubular nozzle 7 is provided at its upper end with an inlet orifice 11 and at its lower end with at least one ejection orifice, and preferably, two side ejection orifices 12 which are diametrically opposite and made in the side wall of said tubular nozzle 7, above a sealing ring 10 mounted on the lower end of said nozzle where its transit channel 13 is axially permanently obturated by a transversal plug 15.

The upper end of the tubular nozzle 7 is connected to its coaxial control rod 8 by means of an overturned bowl or rigid cap 14 of which the top part is fast with said rod 8 and the concave face surrounds and remotely covers over the inlet orifice 11, the said concave face being fixed to the upper end of nozzle 7 by means of a plurality of radial spacing fingers 16. It should be noted that said overturned bowl 14 acts as a bubble trap and has a maximum outer contour which is substantially smaller than the inner contour of the dispensing chamber 24, this in order to avoid any substantial pumping effect during the displacement of nozzle 7.

Said nozzle 7 moves inside dispensing chamber 24 between, on the one hand, a high position (FIGS. 1, 3, 4 and 7) where it is entirely or almost entirely retracted inside chamber 24 and where it does not allow the flow of liquid out therefrom, its lower end being then closed off by the transversal plug 15 and its side ejection orifice 12 being inside the guiding neck 9, against the lower end of which presses the sealing ring or closing member 10 provided on nozzle 7 below ejection orifice 12, and on the other hand, a low position (FIGS. 5,6) where it emerges from the dispensing chamber 24, its upper inlet orifice 11 then being slightly above the bottom of chamber 24 which is equipped with guiding neck 9. Said upper orifice 11 is, on the other hand, situated just above piston 2 when said piston is in low position (FIG. 1, in broken lines) and nozzle 7 in low position (FIG. 1, in broken lines).

According to the embodiment illustrated in FIGS. 1 and 2, the admission valve 5 provided between reservoir 21 and the metering and dispensing device, and to be more precise, between the dispensing chamber 24 and reservoir 21, is a slide valve comprising a cylindrical body of circular cross-section 29 resting without play on a cradle 30 of appropriate shape, such as a semi-cylindrical shape, also with circular cross-section. The superposed bottoms of cradle 30 and of reservoir 21 are provided with an outlet orifice 31 joining with the upper end of conduit 4 connecting reservoir 1 with the metering and dispensing device. The cylindrical body 29 has an axial length which is at least equal to three times the diameter of outlet orifice 31 and which is provided in its median part with a cylindrical annular notch 32, the axial width of which is at the most equal to the diameter of outlet orifice 31. One of the ends of cylindrical body 29 is equipped with a coaxial control rod 29 which traverses in tight manner the side wall 22 of reservoir 21. Thus, admission valve 5 works as a slide valve which is open, when its annular notch 32 covers the outlet orifice 31, as shown in FIG. 2 and closed, when said orifice 31 is closed off by an adjacent part of the cylindrical body 29 when the control rod 29' is pulled to the right as suggested by the double arrow (FIG. 2).

In the case of the embodiment illustrated in FIGS. 1 and 2, the lower face 2a of piston 2 is slightly inclined upwardly so that in low position, i.e. in the delivery position of piston 2, the highest side of inclined lower face 2a is situated about half-height of the opening 26, and the lower part of said surface 2a is situated close to the bottom of metering chamber 1. Thus, if gas bubbles accumulate under the piston 2, said bubbles can easily be transferred to the dispensing chamber 24 and in particular towards the bubble trap 14 wherefrom they will be removed through tubular nozzle 7. In order to prevent gas bubbles from accumulating in the top part of dispensing chamber 24, above the bowl 14, it is possible to give a concave or truncated conical shape to the lower face of the upper wall 33 of said dispensing chamber 24, said concave shape perfectly adopting the shape of the upper face of said bubble trap 14, so that the bubbles are expelled downwardly under said trap 14, when the latter reaches the high position.

According to the second embodiment illustrated in FIGS. 4 to 7, metering chamber 1 and dispensing chamber 24 are superposed inside the same enclosure 25 which, in this case, is cylindrical with vertical axis 20 and circular cross-section. Also in this embodiment, the lower part of the metering chamber is situated directly above the upper part of dispensing chamber 24 and there is no partition between the two chambers 1 and 24. Conduit 4 connecting reservoir 21 with the metering and dispensing device issues at its lower end into the top part of dispensing chamber 24 or into the joining zone between metering chamber 1 and dispensing chamber 24.

As illustrated in FIGS. 3 to 7, the upper end of tubular nozzle 7 can be directly connected with the lower end of control rod 8 which is massive or closed off at its lower end. Bubble trap 14, in this case, is constituted by an overturned bowl or by a sort of truncated cap which surrounds the side inlet orifice or orifices 11 into transit channel 13 of the nozzle and is fixed, by its upper end, to the lower end of rod 8. Because of the superposed position of chambers 1 and 24, the cylindrical enclosure 25 has an axial height which is at least equal to the sum of the maximum strokes of piston 2 and of nozzle 7, said piston 2 being annular-shaped and provided with a central opening adjusted in such a way that said piston 2 surrounds the control rod 8, and slides in tight manner thereon, and control rod 6 of piston 2 being tubular shaped, surrounding part of control rod 8 and being slidable in tight manner thereon.

It is possible to provide on the lower face of piston 2, a downwardly truncated conical cavity 34, centered on axis 20 and entirely situated under the inner sealing ring of piston 2. Nozzle 7 is equipped, at its upper part, i.e. immediately level with and above its inlet orifice 11, with an overturned bowl 14 of truncated shape having a truncated conical upper face complementing that of the cavity 34. Said bowl 14, which also includes a truncated lower face and acts as a bubble trap, resembles a small umbrella, and is less wide than chambers 1 and 24, so as not to act as a piston therein and so that the liquid can easily flow around it when piston 2 and/or said bowl move.

The metering and dispensing device ends at its lower end in a guiding neck 9 via which it can be fixed on a tunnel 17 and can penetrate inside said tunnel 17. The tunnel 17 is, for example, sterile and forms part of a packing installation of the type which thermo-forms, fills, seals and cuts the containers 3 and in which the bottom of tunnel 17, supplied with a slightly pressurized sterile gas, is closed, in non-tight manner, by a thermoplastic strip 18 in which the containers 3 are shaped with their inner face turned towards the tunnel 17 made sterile for the packing operations. The sterile gas then escaping between the lower edges of the tunnel and the strips or band 18. Said band 18 moves stepwise under the action of clamps 19 of lateral driving chains. Moreover, when the reservoir 21 which is situated above the metering chamber 1 contains a sterile product P, means should be provided so that the parts of rods 6 and 8 which go through the reservoir 1 or penetrate therein, remain sterile.

To this effect, reservoir 21 is closed off and partly filled with a sterile liquid product P from a suitable source and through a valve 35, the opening of which is controlled by a first level sensor 36 indicating the minimum level of the liquid product P in reservoir 21, the closure of which is controlled by a second level sensor 37 which indicates the maximum level of product P. The free space 38 at the top of reservoir 21 above product P is filled and permanently supplied with slightly pressurized sterile air through an orifice 39. The upper ends of the tubular piston rod 6 and of control rod 8 move inside upper free space 38 and are separately connected to two actuating rods 40, 41 the lower ends of which move vertically in stroke lengths which correspond respectively to the strokes of piston 2 and of tubular nozzle 7. Said actuating rods 40, 41 of vertical parallel axes, also go through a sterile lock chamber 42 provided above reservoir 21, while being guided in tight manner through the horizontal partition wall 43 between lock chamber 42 and reservoir 21, and through the upper horizontal wall 44 of said chamber 42. The chamber 42 permanently supplied with slightly pressurized sterilized air, flowing into said chamber through an upper orifice 45, and out of it through a lower orifice 46. The height of lock chamber 42 is at least equal to the maximum stroke of piston 2 or of tubular nozzle 7, and the sterile air pressure inside said lock chamber 42 is less than the sterile air pressure inside reservoir 21. Thus the risks of pollution inside reservoir 21 are kept to a minimum.

Figure 5:
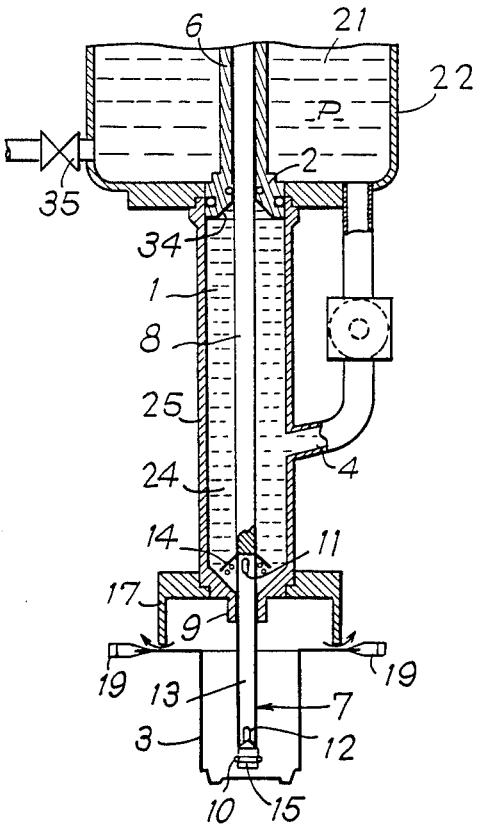
FIG. 5 diagrammatically shows an axial section of the second embodiment at the start of the filling of a container.
Figure 6:
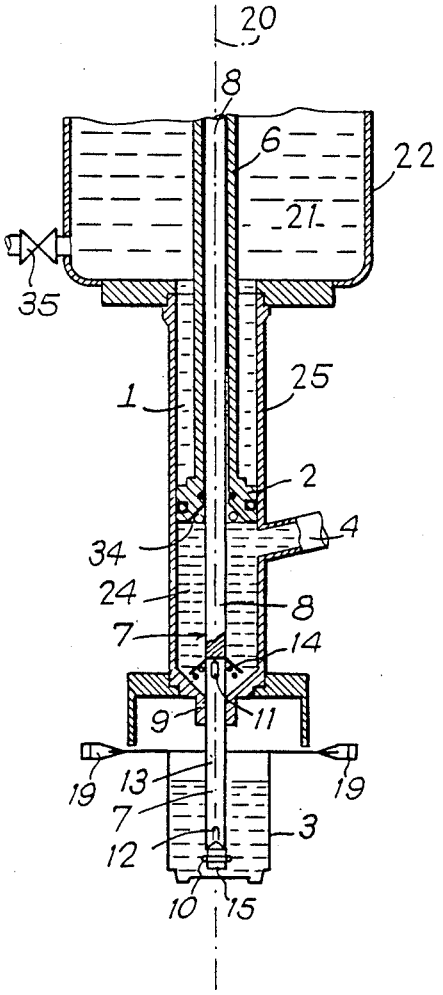
FIG. 6 diagrammatically shows an axial section of the second embodiment at the end of the filling operation.
Figure 7:
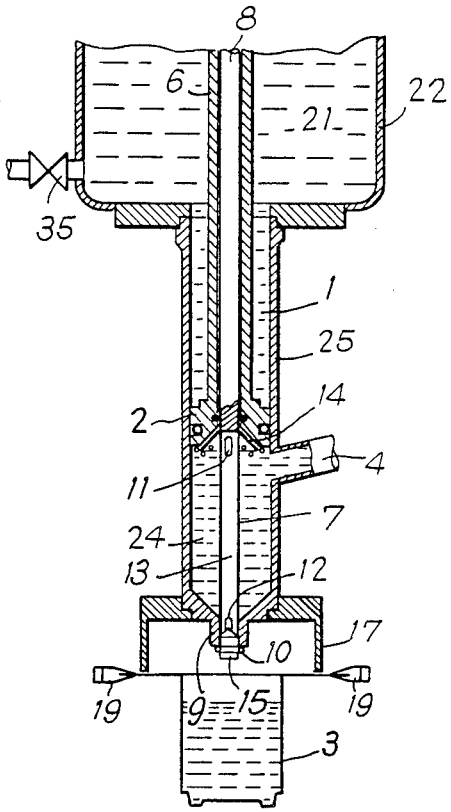
FIG. 7 diagrammatically shows an axial section of the second embodiment at the start of the filling of the metering chamber.

The metering and dispensing device according to the invention works as follows:

When the superposed chambers 1 and 24 have been filled with the liquid to be packed (FIG. 4), valve 5 is closed, piston 2 is then in high position and nozzle 7 goes down from its high position in which the bubble trap is slightly above the mouth of conduit 4, to take up its low position in which its side ejection orifice 12 comes near to the bottom of container 3 to be filled (FIG. 5). Filling of container 3 is achieved by the downstroke of piston 2 which forces the liquid, along with entrapped bubbles, into nozzle 7 through its upper inlet orifice 11, and out of said nozzle via its internal flowing channel 13 through its lower ejection orifice 12, which latter is preferably always kept above the bottom of container 3 during the filling operation.

At the end of the filling operation (FIG. 6), nozzle 7 is raised up so that its sealing ring 10 presses tightly against the guiding neck 9, valve 5 is opened (FIG. 7) and finally, piston 2 is raised up from its low position above the mouth or outlet of conduit 4 (FIG. 6) so as to admit another metered quantity of liquid into chamber 1 as soon as the space inside the latter is closed at the level of guiding neck 9, by the raising of nozzle 7 to the high position (FIG. 7), in which sealing ring 10 presses tightly against guiding neck 9.

A plurality of devices such as described hereinabove may be grouped in range manner to allow the simultaneous filling of a plurality of containers 3 placed side by side.

What is claimed is:

1. Metering and dispensing device for packing liquid products, such as food products, in pots or similar containers, comprising a reservoir for a product, metering means including a cylindrical metering chamber connected via an admission valve with said reservoir and a piston movable between high and low positions in said metering chamber, dispensing means equipped with a downwardly facing tubular nozzle, said nozzle having an upper inlet orifice and a lower ejection orifice and being movable longitudinally, said dispensing means including a dispensing chamber which communicates with the metering chamber and with the exterior of the device through the tubular nozzle, and a closing member operationally coupled to said nozzle, and actuating means for actuating the piston and the nozzle is such a way as to lower the nozzle before filling each container with liquid introduced via said nozzle under delivery action of the piston, an enclosure receiving the metering chamber and the dispensing chamber; the tubular nozzle has a transit channel with a lower end which is permanently closed by a transversal plug; at least one lower nozzle-ejection orifice opening laterally through said nozzle from said transit channel just above said transversal plug, the enclosure which receives the metering and dispensing chambers having a bottom with a guiding neck receiving the tubular nozzle which is mounted therein in a tight manner in such a way as to be slidable therein between a high position in which the ejection orifice is contained inside the guiding neck and is isolated from the exterior of the device, and the inlet orifice of the nozzle is situated in the dispensing chamber which receives the entire nozzle above the ejection orifice, and a low position in which most of the nozzle projects downwardly from the guiding neck with the inlet orifice situated in the dispensing chamber; and a gas bubble trap overlying the inlet orifice of the tubular nozzle, said gas bubble trap being fast with the tubular nozzle above the inlet orifice and defining a downwardly opening cavity about and immediately above said inlet orifice for interception and entrapment of bubbles for passage into said inlet orifice and discharge through said nozzle, said bubble trap having a smaller contour than the dispensing chamber in order to prevent any significant pumping effect in response to movement of the nozzle.

2. Device as claimed in claim 1, wherein the metering chamber and the dispensing chamber are juxtaposed inside the enclosure and communicate together through an opening in a partition wall provided between the two chambers.

3. Device as claimed in claim 1, wherein the enclosure is cylindrical with a vertical axis and a circular cross-section, the metering chamber and the dispensing chamber being superimposed inside the cylindrical enclosure with the metering chamber situated directly above the dispensing chamber.

4. Device as claimed in claim 1, wherein the reservoir overlies the enclosure containing both the metering and dispensing chambers and the metering chamber communicates directly with said reservoir.

5. Device as claimed in claim 1 wherein the dispensing chamber and the reservoir have a common wall portion.

6. Device as claimed in claim 1, including a conduit connecting the reservoir and the enclosure between the metering chamber and the dispensing chamber.

7. Device as claimed in claim 1, wherein the tubular nozzle is connected to a control rod.

8. Device as claimed in claim 7, wherein the tubular nozzle is connected to the control rod via said bubble trap and a plurality of radial spacing fingers.

9. Device as claimed in claim 7, wherein the control rod of the tubular nozzle extends upwardly and penetrates into the reservoir of the product to be packed.

10. Device as claimed in claim 1, wherein the piston of the metering means comprises a control rod which extends upwardly and penetrates into the reservoir of the product to be packed.

11. Device as claimed in claim 3, wherein the tubular nozzle and the piston are actuated by coaxial control rods centered on the vertical axis of the enclosures, said piston being annular-shaped and provided with a central opening adjusted for the tight passage of the nozzle control rod.

12. Device as claimed in claim 1, wherein the admission valve is a slide valve.

13. Device as claimed in claim 1, wherein the reservoir has an outlet orifice and a conduit connecting the reservoir outlet orifice with the enclosure, said admission valve being in the reservoir above the reservoir outlet orifice.

14. Device as claimed in claim 1, wherein the reservoir is topped with a lock chamber, actuating rods traversing said lock chamber in a sealed manner and extending in a sealed manner into the reservoir, means connecting one actuating rod to the piston for control thereof, and means connecting another actuating rod to the tubular nozzle for control thereof, said lock chamber and the reservoir being supplied with sterile air.

15. Device as claimed in claim 1, wherein the piston includes a lower face defining a downwardly directed cavity, and the bubble trap has an upper face of shape complementary to that of said cavity of the piston, which upper face seats within said cavity when the nozzle is in its high position and the piston in its low position.

16. Device as claimed in claim 15, wherein the cavity and the bubble trap are of a substantially truncated conical shape.

* * * * *